US006547159B1

(12) United States Patent
Westby

(10) Patent No.: US 6,547,159 B1
(45) Date of Patent: Apr. 15, 2003

(54) CONNECTOR KIT FOR IRRIGATION DEVICES

(76) Inventor: James P. Westby, 688 Shenandoah Ave., San Marcos, CA (US) 92078

( * ) Notice: Subject to any disclaimer, the term of this patent is extended or adjusted under 35 U.S.C. 154(b) by 0 days.

(21) Appl. No.: 09/714,566

(22) Filed: Nov. 17, 2000

(51) Int. Cl.[7] ..... B05B 15/10

(52) U.S. Cl. ..... 239/204; 239/600; 285/148.23; 285/148.18

(58) Field of Search ..... 239/600, 200–210, 239/590; 285/5, 12, 148.18, 148.27, 123.15, 901

(56) References Cited

U.S. PATENT DOCUMENTS 4,003,520 A * 1/1977 Bailey ..... 239/205
4,274,592 A * 6/1981 Westhusin ..... 239/200
4,589,688 A * 5/1986 Johnson ..... 285/12
4,813,569 A * 3/1989 Ruiz ..... 138/89
4,971,366 A * 11/1990 Towsley ..... 285/12
5,133,501 A * 7/1992 Marshall ..... 239/201
5,199,645 A * 4/1993 Anderson et al. ..... 239/310
5,217,138 A * 6/1993 Nichols ..... 220/403
5,257,826 A * 11/1993 Prassas et al. ..... 285/12
5,375,887 A * 12/1994 Johnson ..... 285/12
5,429,268 A * 7/1995 Hale et al. ..... 220/254
5,472,025 A * 12/1995 Conrad et al. ..... 285/12
5,635,058 A * 6/1997 Bowman ..... 210/172
6,357,668 B1 * 3/2002 Doshay ..... 239/201

* cited by examiner

*Primary Examiner*—Michael Mar
*Assistant Examiner*—Dinh Q. Nguyen
(74) *Attorney, Agent, or Firm*—Rick Martin; Patent Law Offices of Rick Martin, PC

(57) ABSTRACT

Kits (29) for increasing the height of sprinkler water origination include reducing connectors (14)(14*a*)(14*b*) or variants thereof The connectors have a wide cylindrical member (21)(21*a*)(21*b*) with an inner thread set (25)(25*a*) and an inner cylindrical member (23)(23*a*)(23*b*) with an inner thread set (26) and a disk section (24)(24*a*)(24*b*). The kits include, in some forms, an enclosure (32) and/or instructions (31); in others, a display of kits.

20 Claims, 3 Drawing Sheets

CONNECTOR KIT FOR IRRIGATION DEVICES

BACKGROUND OF THE INVENTION

This invention relates to new kits for use by landscapers and others. More particularly, the kit components can, i.e., be attached to the exterior risers of existing or new "pop-up" or other sprinkler units having exterior threads at their upper ends. The kits are particularly useful for extending the height of sprinkler heads used with growing shrubbery.

It is well known that irrigation system sprinkler heads must be adjusted to a position above the height of the nearest plants if more remote plants are to receive adequate irrigation. A variety of approaches have been taken to the solution of the problem of quickly and cheaply adjusting the height of the sprinkler heads. The following references indicate the general approaches taken to the solution of this problem.

J. D. Byles, U.S. Pat. No. 5,716,004, teaches a system having a conduit housing from which conduits (tubing) extend outwardly at near ground levels to irrigate all or portions of the nearby shrubs.

H. K. Rader, U.S. Pat. No. 1,833,040, J. C. Cole, U.S. Pat. No. 4,099.670; and K. Hanaoka, U.S. Pat. No. 5,141,255 each teach equipment where inner risers are slid or screwed upwardly and locked in place to position the sprinkler head at a desired height.

W. R. Marshall, U.S. Pat. No. 5,133,501 utilizes a telescoping riser system.

G. S. Dyck, U.S. Pat. No. 3,776,463 teaches a coupled riser system.

Some of these systems contain male/female couplers or spacers.

Landscapers do not like to dig up "pop-up" sprinkler or equivalent units which are embedded in the soil and, sometimes, the thatch above the soil. The present invention allows the landscaper to remove or leave the external riser of the embedded sprinkler in place as desired. Preferably, the kits of this invention allow the landscaper to remove the pop up inner riser, spring, etc., and merely screw the connector onto the in situ external riser.

SUMMARY OF THE INVENTION

The invention is in the form of kits. The kits include at least one female/female reducing connector attachable via a narrow screw or other "thread set" to a fixture, pipe or irrigation device and another thread set which is connectable to an irrigation lateral directly or through a fixture. The kits can include a variety of packaged fixtures and pipe lengths as well as other sprinkler system components and displays of non-packaged single or multiple components. Preferably, the connector is a female/female reducing connector sized at one end to connect to the top of an external riser of a pop-up sprinkler unit with a wide cylinder and a narrow cylinder in the same horizontal plane. Various fixtures can be included within the kits as well as other sprinkler system components.

BRIEF DESCRIPTION OF THE FIGURES

The exploded depiction of various kit components in FIG. 1 show a mechanism for connection of the connector to a water source and various irrigation outlets.

DETAILED DESCRIPTION OF THE FIGURES

The elements of the Figures are indicated by Arabic numerals. Where there is a change in the form of an element or a change in its relationship, an alphabetic designator is added.

Figure 1:
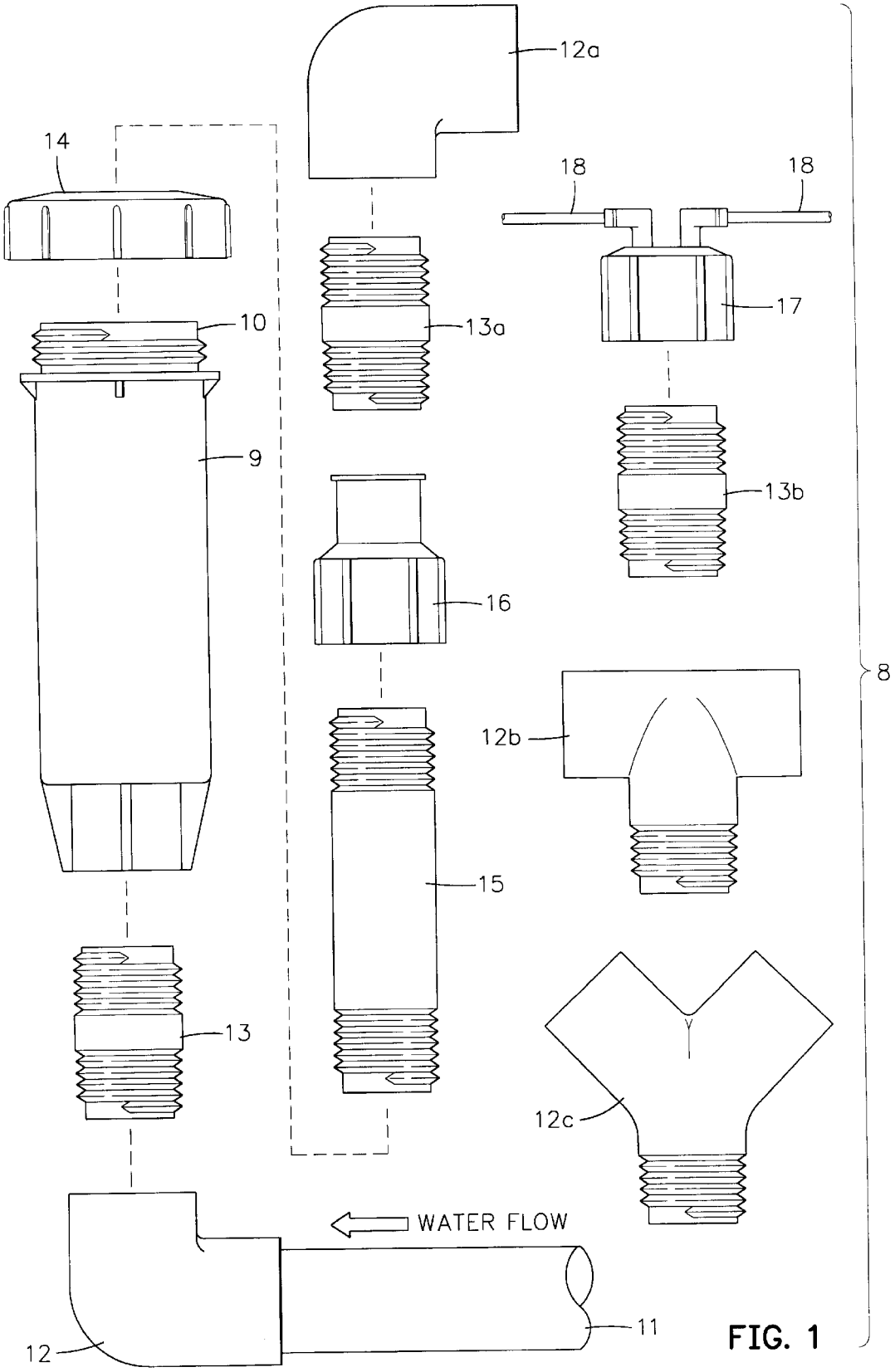

FIG. 1 depicts the various components of a new exterior riser of a type used in commercial pop-up and other lawn sprinklers. The riser 9 has internally positioned female screw threads (not shown) at its lower end and exterior screw threads 10 at its top. In practice, such risers 9 are attached to an irrigation lateral 11 through a fixture, e.g., an "elbow" 12*a*, a "T" 12*b* or a "Y" 12*c*. Nipple 13 is used to attach the riser 9 to the elbow 12.

Riser 9 attaches to connector 14 and connector 14 connects to a fixture, e.g., nipple, 13*a* or 13*b* or 13*c* or a pipe 15. Pipe 15 is of a predetermined length which enables the water to be expelled through a sprinkler or shrubbery head 16 or a manifold 17 and its small diameter tubes 18. Alternately, the connector 14 enables the landscaper to connect to the illustrated and homologous fixtures through elbows 12*a*, "T" 12*b*, or "Y" 12*c*. The fixtures can be as shown or have one or more male or female thread replacements for the threads shown. For example, where a second appropriate male thread is used with fixtures 12*a* or 12*b*, a garden hose can be attached to it to extend the reach of the lateral as well as supply a sprinkler head. Alternately, the nipples can be configured with one set of male and enclosed female threads similar to those of fixtures 12*a* and 12*b*.

Figure 2:
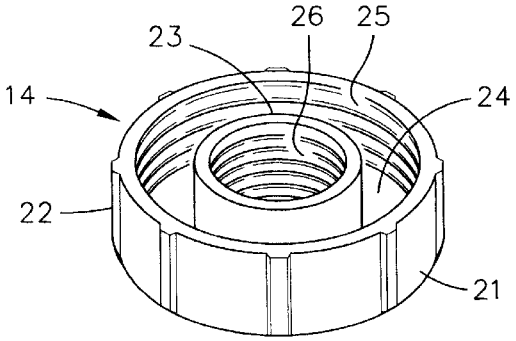
FIG. 2 is a perspective view of a form of a single plane form of a reducing connector of this invention.
Figure 3:
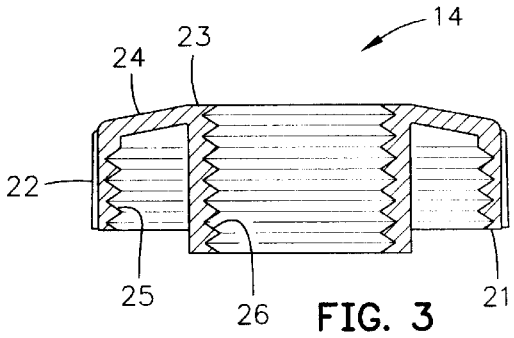
FIG. 3 is a half section view of the connector of FIG. 2.

FIGS. 2 and 3 show a reducing connector 14. As viewed, connector 14 has a cylindrical, substantially vertical, wide member 21 with ribs 22 on its external surface to ensure the user a better grip. A cylindrical, substantially vertical, narrow member 23 is joined to vertical member 21 by a substantially horizontal, disk-shaped section 24. The inner surfaces of vertical members 21 and 23 have threaded sections 25 and 26. The threads of section 25 can differ from those of thread section 26. Section 26 threads are ordinarily complementary to the threads of common irrigation pipe and fixtures. The threads of irrigation or similar piping and fixtures generally, but not always, have threads with common characteristics and are therefore generally complementary because standards have been established for such piping and fixtures.

Currently, pop-up and other sprinkler units of equivalent usage have outer thread sections with threads of different depth, width and/or angularity so that the manufacturers can enhance parts sales of their proprietary designs.

Figure 4:
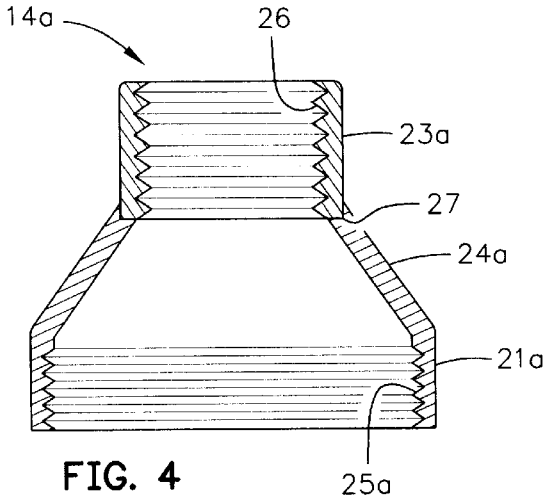
FIG. 4 is a half section view of a connector in the form of a funnel with a frustoconical disk segment.

The funnel-shaped connector 14*a* of FIG. 4 has a wide vertical member 21*a*, an inwardly angled, frustoconical section 24*a* and a narrow vertical member 23*a*. Vertical member 23*a* is attached to section 23*a* at fused or adhesed junction 27 and can be of a different material, color or opacity. The vertical threads of member 21*a* differ from equivalent threads of FIGS. 2 and 5 to note the commercial thread differences. While the inwardly angled section is frustoconical, it can also have sides which curve outwardly or inwardly from the straight sides shown.

Figure 5:
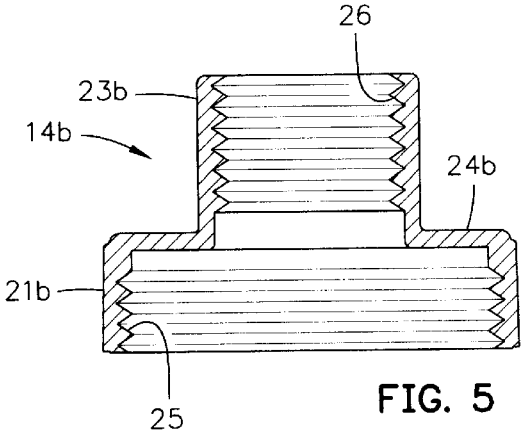
FIG. 5 is a half section of a connector having a stepped funnel shape.

The reducer 14*b* of FIG. 5, like that of FIG. 3, has the vertical member 23*b* positioned on a plane above the horizontal plane arrangement of FIGS. 2 and 3 but joined by a horizontal section 24*b* like the unit of FIGS. 2 and 3.

Figure 6:
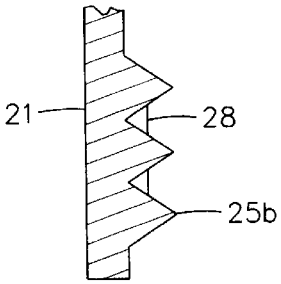
FIG. 6 depicts a thread-seated seal.

FIG. 6 depicts a portion of the vertical members 21, 21*a* and 21*b* with a soft polymeric seal 28 imbedded in the "valley" of the threads 25, 25*a* and 25*b*. Such seals can be sprayed onto the bottom of the surface of the thread of connector materials having polar surfaces or onto non-polar surfaces which have been treated to create needed polarity.

Figure 7:
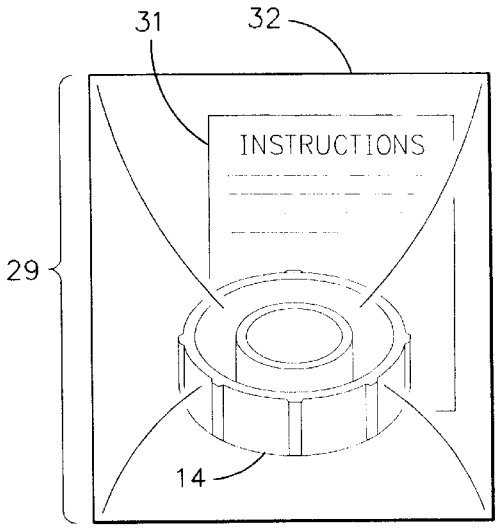
FIG. 7 depicts the preferred connector and instructions within an illustrative enclosure.

In FIG. 7, connector 14 and instructions 31, for ease, are contained within a plastic film enclosure 32 but can be on or attached to the connector.

Figure 8:
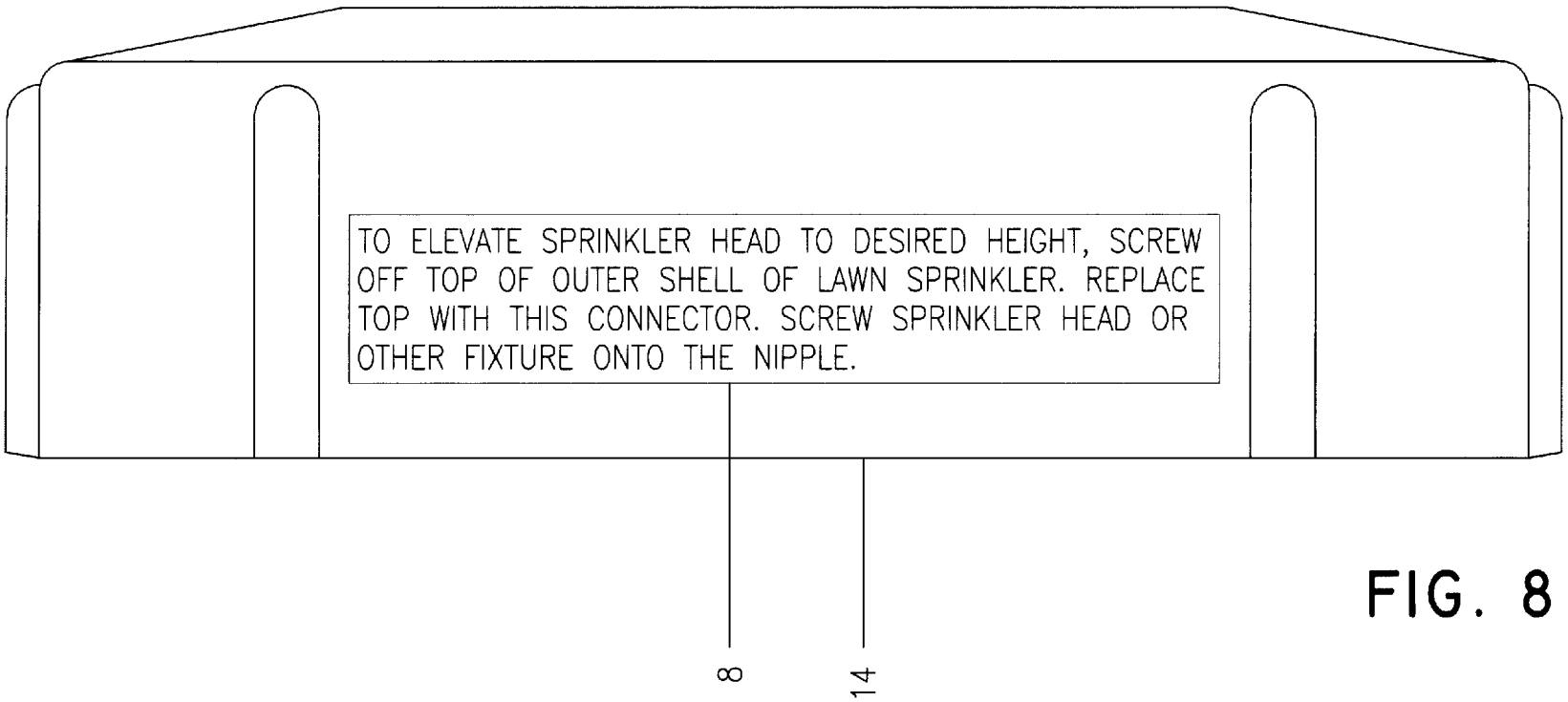
FIG. 8 depicts a connector with instructions imprinted on its side.

FIG. 8 shows a connector 14 of FIG. 1 having instructions 7 for use imprinted on its side.

GENERAL DESCRIPTION OF THE INVENTION

The kits can be in several forms, e.g., a single reducing connector on or within an enclosure, a large display table, wall shelving with or without separators, a collection of connectors or a collection of a connector or connectors and other sprinkler system components. The instructions for usage can be stamped or molded on the connector, or a larger kit component, contained in a container with the kit or associated with a table, wall or floor display.

The components of the kits shown in the Figures are in terms of the shapes and connecting threads used in current commercial sprinkler equipment. Plastic is the preferred material for the kit irrigation system components although metals can be used. The kit components can be manufactured from any of the plastics will have the requisite strength and durability under conditions of usage. One or more of nylon, polyformal, polyester and polyolefin of the appropriate castability or extrudability is preferred. Brass is a preferred metal alloy. The external risers to which the connectors are attached are generally used in the pop-up type sprinklers but can be "screw-up or other types, e.g., as shown or discussed by a variety of patents discussed earlier. The enclosures will preferably be highly flexible plastic film although polystyrene, or other comparable polymeric or cellulosic material can be used.

The kits will contain instructions for the use of the connectors, fixtures, piping, etc. enabling the user to utilize the connector to the user's best advantage. The instructions can be in any appropriate form, e.g., ink on paper, the surface of the connectors, or on displays. Alternately, the instructions can be in the form of voice or video cassette, tapes, or discs and can be provided by voice, print or pictures.

Continuous threads used for connecting the system components in the Figures, etc., can be square, pointed, etc., but the pointed threads currently are preferred for commercial landscaping usage. However, other thread lengths can be utilized, for example, the short half turn or one turn threads used with cosmetic containers can be substituted. In some such instances, it will be useful to include seals, especially where operating water pressures are high. For example, the seals can be "O" rings, designs using "edge" seals or thread coatings and/or groove fillers which are compressed between the interlocking surfaces. The term "disk" is meant to include both flat and frustoconical disks as shown in the Figures with the understanding that the walls of the frustoconical shapes do not have to be smooth and can bulge outward or sag inward from the frustoconical disk of FIG. 4.

FIG. 4 is illustrative of a commercial practice of marketing sprinkler components, e.g., sprinkler heads, made up of two or more elements rather than a single piece. The elements can be heat welded, force-fitted together, interlocked, adhesed or fused together.

What is claimed is:

1. In a kit for modifying a pop-up sprinkler unit having an external riser pipe which is threaded at a lower end for connection to a water source and has external threads formed on an upper end, an internal riser pipe slidably received within the external riser pipe, and a sprinkler head mounted on an upper end of the internal riser pipe being configured to rise relative to the external riser pipe when water is flowing through the riser pipes, the kit comprising:

a female/female reducing connector formed with inner and outer wall members, the wall members being annular-shaped and concentrically arranged, the wall members further being spaced apart at their lower ends and joined at their upper ends by a disk-shaped member, the outer wall member having an inner surface formed with internal threads and the inner wall member having an inner surface formed with internal threads; and one of a pipe, nipple, or fixture having external threads on at least a lower end thereof, wherein the kit is configured for modifying the pop-up sprinkler by replacing the internal riser pipe with the reducing connector and one of a pipe, nipple, or fixture; the reducing connector being configured for attachment to the external riser pipe with the external threads on the upper end of the riser pipe in threaded engagement with the internal threads on the outer wall member of the reducing connector, and each one of the pipe, nipple, or fixture in threaded engagement with the internal threads on the inner wall of the reducing connector.

2. The kit of claim 1 further including at least one of a fixture and a pipe.

3. The kit of claim 2 further including an external riser for use in a sprinkler system.

4. The kit of claim 3 further including a pair of nipples.

5. The kit of claim 3 further including a pair of nipples and at least one of a sprinkler head, a shrubbery head and a tube manifold.

6. The kit of claim 3 further including a pair of nipples and at least one of a sprinkler head, a shrubbery head and a tube manifold.

7. The kit of claim 2 in which the fixture is a nipple.

8. The kit of claim 2 wherein the fixture is a "T" fixture.

9. The kit of claim 2 wherein the fixture is a "Y" fixture.

10. The kit of claim 1 further including at least one of a sprinkler head, a shrubbery head, and a tube manifold.

11. The kit of claim 1 consisting of a combination of a female/female reducing connector with the wide member and the narrow member substantially in the same horizontal plane.

12. The kit of claim 1 consisting of a combination of a female reducing connector with the wide member and the narrow member in different horizontal planes.

13. The kit of claim 1 further including a pair of nipples.

14. The kit of claim 11 further including at least one of an enclosure and a display.

15. The apparatus of claim 1, wherein the kit further comprises associated instructions for the combination of at least one of a pipe, nipple or fixture having external threads on at least one end, wherein the kit is configured for threaded engagement with the internal threads on the inner wall member of the reducing connector.

16. The kit of claim 15 further including at least one of a fixture and a pipe.

17. The kit of claim 16 in which the fixture is a nipple.

18. The kit of claim 15 further including at least one of a sprinkler head, a shrubbery head, and a tube manifold.

19. The kit of claim 15 further including an external riser for use in a sprinkler system.

20. The kit of claim 1 further including a display.

* * * * *